US012590375B2

(12) United States Patent
Grass et al.

(10) Patent No.: US 12,590,375 B2
(45) Date of Patent: Mar. 31, 2026

(54) ELECTROCHEMICAL PROCESS FOR PRODUCTION OF TETRAALKYL 1,2,3,4-BUTANETETRACARBOXYLATES

(71) Applicant: Evonik Oxeno GmbH & Co. KG, Marl (DE)

(72) Inventors: Michael Grass, Haltern am See (DE); Johannes Kraft, Offenbach (DE); Michael van Eickels, Recklinghausen (DE); Sebastian Arndt, Ginsheim Gustavsburg (DE); Carl-Friedrich Hoppe, Gruendau (DE); Stephan Becker, Marl (DE); David Sascha Bremer, Recklinghausen (DE)

(73) Assignee: Evonik Oxeno GmbH & Co. KG, Marl (DE)

( * ) Notice: Subject to any disclaimer, the term of this patent is extended or adjusted under 35 U.S.C. 154(b) by 0 days.

(21) Appl. No.: 19/010,449

(22) Filed: Jan. 6, 2025

(65) Prior Publication Data

US 2025/0230557 A1 Jul. 17, 2025

(30) Foreign Application Priority Data

Jan. 11, 2024 (EP) ..... 24151277

(51) Int. Cl.

| | |
|---|---|
| ***C25B 3/07*** | (2021.01) |
| ***C25B 3/25*** | (2021.01) |
| ***C25B 3/29*** | (2021.01) |
| ***C25B 11/043*** | (2021.01) |

(52) U.S. Cl.
CPC ..... *C25B 3/07* (2021.01); *C25B 3/295* (2021.01); *C25B 11/043* (2021.01)

(58) Field of Classification Search
CPC .. C25B 3/07; C25B 3/25; C25B 3/295; C25B 11/043
USPC ..... 205/415, 418, 441, 440
See application file for complete search history.

(56) References Cited

U.S. PATENT DOCUMENTS

| | | | |
|---|---|---|---|
| 2004/0035715 | A1 | 2/2004 | Putter et al. |
| 2007/0287781 | A1 | 12/2007 | Grass et al. |

FOREIGN PATENT DOCUMENTS

| | | | | |
|---|---|---|---|---|
| EP | 0 816 533 | A2 | 1/1998 | |
| EP | 0 816 533 | A3 | 1/1998 | |
| EP | 2 900 847 | B1 | 3/2021 | |
| JP | 5-156478 | A | 6/1993 | |
| WO | 97/26389 | A1 | 7/1997 | |
| WO | 02/42249 | A1 | 5/2002 | |
| WO | WO-2009071478 | A1 * | 6/2009 | ..... C25B 3/295 |
| WO | 2014/046798 | A2 | 3/2014 | |

OTHER PUBLICATIONS

European Search Report received for European Patent Application No. 24151277.1 mailed on Jun. 18, 2024, 8 pages.
European Search Report received for European Patent Application No. 25150207.6, mailed on Jun. 5, 2025, 9 pages.

* cited by examiner

*Primary Examiner* — Edna Wong
(74) *Attorney, Agent, or Firm* — Grüneberg Global IP, PLLC

(57) ABSTRACT

An electrochemical process produces tetraalkyl 1,2,3,4-butanetetracarboxylates having alkyl groups with 1 to 6 carbon atoms. The process employs an electrohydrodimerization of dialkyl maleates having alkyl groups having 1 to 6 carbon atoms in a reactant solution with an alcohol and a conducting salt.

14 Claims, No Drawings

ELECTROCHEMICAL PROCESS FOR PRODUCTION OF TETRAALKYL 1,2,3,4-BUTANETETRACARBOXYLATES

CROSS-REFERENCE TO RELATED APPLICATIONS

This patent application claims priority to European Patent Application No. 24151277.1, filed on Jan. 11, 2024, in the European Patent Office, the entire disclosure of which is hereby incorporated by reference herein.

BACKGROUND OF THE INVENTION

Field of the Invention

The present invention relates to an electrochemical process for producing tetraalkyl 1,2,3,4-butanetetracarboxylates containing alkyl groups having 1 to 6 carbon atoms. The process comprises the electrohydrodimerization of dialkyl maleates containing alkyl groups having 1 to 6 carbon atoms in a reactant solution containing an alcohol and a conducting salt.

Description of Related Art

Tetraalkyl 1,2,3,4-butanetetracarboxylates are known esters in the chemical industry and have the following general structure

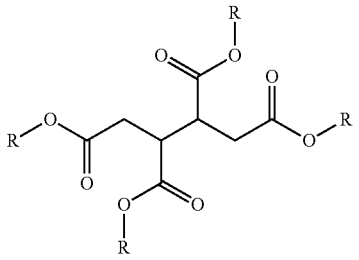

wherein all four radicals R represent an alkyl radical. These esters may be employed as plasticizers for example.

Tetraalkyl 1,2,3,4-butanetetracarboxylates may in principle be produced by chemical and electrochemical means. The chemical route proceeds via the synthesis of 1,2,3,4-butanetetracarboxylic acid with subsequent esterification with an alcohol to afford the corresponding tetraalkyl 1,2,3,4-butanetetracarboxylate. The electrochemical route proceeds via a hydrodimerization of dialkyl maleate occurring at the cathode. Such processes have in some cases already been described in the patent literature, for example in EP 0 816 533 A2, in WO 97/26389 A1, in WO 02/42249 A1 or in JP H05 156478 A1.

The known processes have the disadvantage that they either cannot be operated economically or cannot be operated sustainably on an industrial scale. An alternative route for producing the relevant tetraalkyl 1,2,3,4-butanetetracarboxylates is also to be provided.

SUMMARY OF THE INVENTION

It was therefore an object of the present invention to provide an economic and sustainable process for producing tetraalkyl 1,2,3,4-butanetetracarboxylates. This object is achieved by the process described herein. Preferred embodiments are also specified in the dependent embodiments.

DETAILED DESCRIPTION OF THE INVENTION

The process according to the invention for producing tetraalkyl 1,2,3,4-butanetetracarboxylates containing alkyl groups having 1 to 6 carbon atoms, preferably alkyl groups having 2 to 5 carbon atoms, particularly preferably having 5 carbon atoms, is carried out by electrohydrodimerization in at least one reaction zone comprising an anode and a cathode with a reactant solution comprising dialkyl maleates containing alkyl groups having 1 to 6 carbon atoms, preferably alkyl groups having 2 to 5 carbon atoms, at least one monohydric alcohol having 1 to 6 carbon atoms, preferably having 2 to 5 carbon atoms, and a conducting salt, wherein the dialkyl maleates are electrohydrodimerized to afford tetraalkyl 1,2,3,4-butanetetracarboxylates at the cathode and wherein the anode and the cathode employed are boron-doped diamond electrodes.

The use of boron-doped diamond electrodes as electrode material has the advantage that the cell voltage during the reaction is lower than when using known electrode materials such as graphite or glassy carbon. The electrical energy consumption of an electrolysis is proportional to the cell voltage. With boron-doped diamond electrodes, the process according to the invention can therefore be conducted in a more energy-saving manner.

The dialkyl maleates used in the electrohydrodimerization containing alkyl groups having 1 to 6 carbon atoms, preferably alkyl groups having 2 to 5 carbon atoms, particularly preferably having 5 carbon atoms, are reacted according to the known mechanism. The employed dialkyl maleates are available on an industrial scale.

In a preferred embodiment of the present invention, dialkyl maleates each comprising alkyl groups having 5 carbon atoms, i.e. dipentyl maleates, are employed. In the process according to the invention, this forms tetraalkyl 1,2,3,4-butanetetracarboxylates comprising alkyl groups each having 5 carbon atoms, i.e. a tetrapentyl 1,2,3,4-butanetetracarboxylate.

In the present context, the term "pentyl" is to be understood as meaning that the esters according to the invention may contain the various pentyl isomers n-pentyl (1-, 2- or 3-pentyl), 2-methylbutyl, 3-methylbutyl, 2-methylbut-2-yl, 3-methylbut-2-yl, 2,2-dimethylpropyl, in particular 2-methylbutyl and/or 3-methylbutyl and/or n-pentyl. The term "pentyl" therefore does not refer to a single specific C5 alkyl group. The tetrapentyl 1,2,3,4-butanetetracarboxylates preferably produced according to the invention may therefore contain exclusively 2-methylbutyl groups, exclusively 3-methylbutyl groups, exclusively n-pentyl groups or a mixture of 2-methylbutyl and/or n-pentyl and/or 3-methylbutyl groups.

In addition to the dialkyl maleate, the reactant solution comprises at least one monohydric alcohol having 1 to 6 carbon atoms, preferably having 1 to 5 carbon atoms. Preferred alcohols are methanol and pentanol. The pentanol may be a mixture of different isomeric pentanols, for example a mixture of 2-methylbutanol and/or 3-methylbutanol and/or 1-pentanol. In the electrohydrodimerization according to the invention, the alcohol functions as a solvent because the dialkyl maleate and the conducting salt may be dissolved in the employed alcohol. The alcohol may simultaneously also serve as the reactant for the anode reaction. In principle, it is also possible to employ a mixture of two or more monohydric alcohols having different carbon chain lengths. This can form mixed esters containing different alkyl radicals. However, it is preferable to employ only one alcohol. However, this one alcohol may also represent a mixture of different isomers having the same number of carbon atoms as has already been described. It is further conceivable in principle for the employed dialkyl maleate and the employed alcohol to have different alkyl groups having a different number of carbon atoms. However, it is preferable according to the invention when the number of carbon atoms of the alkyl groups of the dialkyl maleate and the number of carbon atoms of the monohydric alcohol are identical. Thus, if a tetrapentyl 1,2,3,4-butanetetracarboxylate is to be produced from dipentyl maleates, the solvent employed is pentanol.

An influencing factor in the electrohydrodimerization according to the invention is the concentration of dialkyl maleate based on the amount of the alcohol. A higher concentration of dialkyl maleate may have a positive effect on the yield, selectivity and current yield of the tetraalkyl 1,2,3,4-butanetetracarboxylate to be formed. In a preferred embodiment of the present invention, the concentration of dialkyl maleate is 0.5 to 4 mol/litre of monohydric alcohol, preferably 1 to 3 mol/litre of monohydric alcohol.

The reactant solution employed in the electrohydrodimerization according to the invention further comprises a conducting salt. The conducting salt ensures a sufficient conductivity of the solution during the electrochemical reaction. It is in principle possible to employ any conducting salt suitable for the reactant solution and the reaction. Corresponding conducting salt are known in principle to those skilled in the art.

Employable conducting salts for the electrohydrodimerization especially include conducting salts having tetraalkylammonium cations, alkali metal cations and having anions from the group consisting of aromatic-substituted sulfonates, alkylsulfonates, acetates, perchlorates, tetrafluoroborates, tetraphenylborates, bromides, iodides, phosphates, phosphonates, sulfates, alkylsulfates, hexafluorophosphates. Examples of suitable conducting salts include tetrabutylammonium p-toluenesulfonate and sodium acetate.

The concentration of the conducting salt may also be an influencing factor in the electrohydrodimerization according to the invention. Especially low concentrations of conducting salt would be economically advantageous per se but increase cell voltage and therefore have an adverse effect. In the context of the present invention, the concentration of conducting salt is preferably 0.05 to 0.4 mol/litre of monohydric alcohol, preferably 0.1 to 0.4 mol/litre of monohydric alcohol.

The reactant solution must contain at least the dialkyl maleate, the monohydric alcohol and the conducting salt. In a preferred embodiment of the present invention, the reactant solution in the electrohydrodimerization according to the invention additionally comprises a cosolvent. The use of a cosolvent can lead to a reduction in cell voltage. Suitable cosolvents do not react at the cathode in the electrohydrodimerization according to the invention. The cosolvent is preferably selected from the group consisting of acetonitrile, dimethyl sulfoxide, tetrahydrofuran, dioxane, propylene carbonate, N,N-dimethylformamide, organic carbonates (e.g. dimethyl carbonate), dichloromethane, chloroform and acetone.

The electrohydrodimerization according to the invention is carried out in a suitable reaction zone which may comprise one or more reactors. Since an electrochemical reaction is carried out here, it is well known that a reactor must comprise an anode and a cathode. In the context of the present invention, the reactors may also be referred to as an electrolysis cell.

The desired reaction of the dialkyl maleate to afford the target product, the tetraalkyl 1,2,3,4-butanetetracarboxylates, occurs at the cathode. This will naturally be accompanied by a simultaneous oxidation at the anode. It is possible for example for the monohydric alcohol to be oxidized to afford an aldehyde at the anode. Formaldehyde would accordingly be formed if methanol were employed as the monohydric alcohol. The use of butanol would result in formation of butyraldehyde and the use of pentanol as the monohydric alcohol would result in formation of valeraldehyde. Valeraldehyde in particular is an important starting material for syntheses in the chemical industry and therefore represents a valuable product. The use of pentanol would thus result in coproduction of two different valuable products, valeraldehyde and tetrapentyl 1,2,3,4-butanetetracarboxylate. When using dialkyl maleates having different alkyl groups, for example di(2-methylbutyl/n-pentyl)maleate in pentanol, an additional reaction that proceeds to a small extent is the liberation of, in this case, 2-methylbutanol by substitution for pentanol and subsequent anodic oxidation to afford 2-methylbutanal.

The anode and the cathode may be made of known materials, for example metallic or carbon-based materials. In the context of the present invention, the anode and the cathode employed are boron-doped diamond electrodes.

When using boron-doped diamond electrodes, the distance between the anode and the cathode may preferably be adjusted to at least 1 mm (with a suitable plastic frame as a spacer).

The arrangement of the anode and the cathode relative to one another in the electrolysis cell(s) is in principle not limited to particular arrangements. It is clear that the arrangement is selected so as to result in the lowest possible cell voltage. In a preferred embodiment of the present invention, the anode and the cathode are in a plane-parallel arrangement relative to one another in the electrolysis cell.

The electrohydrodimerization according to the invention may in principle be configured as a batch process or as a continuous process. In the case of a batch process, it is well known that the reactant solution is filled into the reactor(s) or the electrolysis cell(s) and reacted and the product mixture is then withdrawn. If the electrohydrodimerization is operated in a continuous mode, fresh reactant solution must be continuously metered into the reactor/the electrolysis cell and resulting product solution withdrawn therefrom.

There is a continuous flow through the reactor/through the electrolysis cell both in the case of a batch process and in continuous mode. This is advantageous inter alia for mass transfer towards the electrodes or away from the electrodes. In this context, the flow rate is the volume flowing through the reactor/the electrolysis cell per unit time.

It must in principle be assumed that a higher flow rate improves mass transfer towards the electrode and away from the electrode. In the context of the present invention, the flow rate is preferably in the range from 50 to 700 l/h per 100 $cm^2$ of electrode surface area in plane-parallel arrangement, preferably from 100 to 500 l/h per 100 $cm^2$ of electrode surface area in plane-parallel arrangement.

A highest possible temperature is advantageous for a low cell voltage but results in elevated demands on materials and, in the case of short-chain alcohols, the vapour pressure increases markedly. The temperature to be set is therefore a compromise between these two requirements. In the context of the present invention, it is therefore preferable when the electrohydrodimerization is performed at a temperature in the range from 20° C. to 80° C., preferably 25° C. to 65° C. It is further preferable when the electrohydrodimerization is performed at a pressure of 0.5 to 3 bar, preferably 0.75 to 2 bar.

The electrochemical parameters are also important influencing factors on the electrohydrodimerization according to the present invention. The current density in the electrohydrodimerization is preferably between 1 and 25 mA/cm$^2$, preferably between 2 and 15 mA/cm$^2$, particularly preferably between 4 and 10 mA/cm$^2$. It is further preferable when only a stoichiometric charge quantity is supplied for the electrochemical reaction. In the present case this is reported as the electrical charge quantity per mol of dialkyl maleate. In the context of the present invention, the electrical charge quantity is preferably in the range from 1 to 1.5 F/mol of dialkyl maleate, preferably 1 to 1.1 F/mol of dialkyl maleate. It is very particularly preferable when only stoichiometric charge quantities are required for the reaction, i.e. the electrical charge quantity is 1 F/mol of dialkyl maleate.

To obtain tetraalkyl 1,2,3,4-butanetetracarboxylates whose alkyl groups comprise 2 or more carbon atoms, preferably whose alkyl groups comprise 5 carbon atoms, it would be possible to initially use the process according to the invention to produce the respective tetraalkyl 1,2,3,4-butanetetracarboxylate from dimethyl maleate or diethyl maleate and subsequently perform a transesterification of this ester with a suitable alcohol.

The present invention therefore also provides a process which comprises producing the tetramethyl 1,2,3,4-butanetetracarboxylate or tetraethyl 1,2,3,4-butanetetracarboxylate by electrohydrodimerization and subsequently transesterifying the tetramethyl 1,2,3,4-butanetetracarboxylate or tetraethyl 1,2,3,4-butanetetracarboxylate with at least one monohydric alcohol having 3 to 6 carbon atoms, preferably having 5 carbon atoms, to afford tetraalkyl 1,2,3,4-butanetetracarboxylates containing alkyl groups having 3 to 6 carbon atoms, preferably having 5 carbon atoms.

Transesterification is a process known per se to those skilled in the art where according to the present teaching a longer-chain alcohol displaces methanol (when using dimethyl maleate) or ethanol (when using diethyl maleate) from the ester. The transesterification with the monohydric alcohol having 2 to 6 carbon atoms, preferably having 5 carbon atoms, is preferably performed in the presence of a catalyst or two or more catalysts, for example using Brønsted or Lewis acids or bases as catalyst. Particularly suitable catalysts have been found to be sulfuric acid, methanesulfonic acid, p-toluenesulfonic acid, metals or compounds thereof. Examples of particularly preferred metal catalysts are tin powders, tin(II) oxide, tin(II) oxalate, titanic esters such as tetraisopropyl orthotitanate or tetrabutyl orthotitanate, and also zirconium esters such as tetrabutyl zirconate, and also sodium methoxide and potassium methoxide.

The transesterification may be performed in typical reactors known to those skilled in the art under customary process conditions. The process is preferably carried out at temperatures at or above the boiling point of the alcohol formed in the reaction so that this can be distilled off from the reaction mixture. The transesterification is preferably performed at a temperature of 100° C. to 300° C., preferably at 120° C. to 270° C. and especially at 140° C. to 250° C. The internal pressure is preferably 0.1 to 20 or 15 bar, in particular 0.1 to 10 bar.

The present invention is elucidated hereinbelow with reference to examples. The specific exemplary embodiments shown are intended to elucidate but not limit the subject matter of the invention.

EXAMPLES

Experimental Apparatus:

The electrohydrodimerization employed an electrolysis cell with plane-parallel arrangement of an anode and cathode plate, each having an area of 100 cm$^2$. The materials employed for the anode and the cathode were either glassy carbon/glassy carbon, graphite/graphite or boron-doped diamond/boron-doped diamond. When using glassy carbon and boron-doped diamond, a PTFE spacer frame of 1 mm in thickness was employed and when using graphite, a PTFE spacer frame of 2 mm in thickness was employed (at 1 mm, shorting occurred and electrosynthesis was impossible). The electrodes were connected to a power supply and an additional voltmeter.

The outflow at the upper region of the cell was passed into a glass intermediate storage vessel with a temperature-controllable outer jacket which was in turn connected to a thermostat. The outlet of the intermediate storage vessel was connected to the suction side of a peripheral wheel pump. Conveying into the inflow at the lower region of the cell was effected from the pressure side of the pump.

Example 1 (not in Accordance with the Invention)

This experiment employed glassy carbon as electrode material. 74 g of di(2-methylbutyl/n-pentyl)maleate (289 mmol) and 24 g (58 mmol) of tetrabutylammonium p-toluenesulfonate were dissolved in 150 ml of pentanol and—after sampling—subsequently filled into the intermediate storage vessel of the experimental apparatus. After starting the pump circulation at 280 l/h and adjusting the temperature control jacket to 50° C., a current of 600 mA (current density 6 mA/cm$^2$) was applied. The experimental duration was 13 hours. Over this period an electrical charge quantity of 0.29 F (corresponding to 1.01 F/mol of di(2-methylbutyl/n-pentyl)maleate) was supplied. The cell voltage was 7.2 V at commencement of the experiment and rose to 7.5 V by the termination of the experiment. After termination of the experiment, 212 g of product electrolyte solution were obtained and analysed by gas chromatography. Said solution contained 38.4 g of tetra(2-methylbutyl/n-pentyl) 1,2,3,4-butanetetracarboxylate (yield 52%, current yield 51%), 13.3 g of di(2-methylbutyl/n-pentyl) succinate (yield 18%), and 20.7 g of di(2-methylbutyl/n-pentyl)maleate (corresponding to a conversion of 72%).

Example 2 (not in Accordance with the Invention)

The experiment employed graphite as electrode material. 74 g of di(2-methylbutyl/n-pentyl)maleate (289 mmol) and 24 g (58 mmol) of tetrabutylammonium p-toluenesulfonate were dissolved in 150 ml of pentanol and—after sampling—subsequently filled into the intermediate storage vessel of the experimental apparatus. After starting the pump circulation at 280 l/h and adjusting the temperature control jacket to 50° C., a current of 600 mA (current density 6 mA/cm$^2$) was applied. The experimental duration was 13 hours. Over this period an electrical charge quantity of 0.29 F (corresponding to 1.01 F/mol of di(2-methylbutyl/n-pentyl) maleate) was supplied. The cell voltage was 9.6 V at commencement of the experiment and fell to 9.2 V by the termination of the experiment. After termination of the experiment, 211 g of product electrolyte solution were obtained and analysed by gas chromatography. Said solution contained 27.5 g of tetra(2-methylbutyl/n-pentyl) 1,2,3,4-butanetetracarboxylate (yield 37%, current yield 37%), 14.3 g of di(2-methylbutyl/n-pentyl) succinate (yield 19%), and 31.9 g of di(2-methylbutyl/n-pentyl)maleate (corresponding to a conversion of 57%). The solution also contained n-pentanal (valeraldehyde) and 2-methylbutanal which, in contrast to the abovementioned cathode products, are anode products.

Example 3 (not in Accordance with the Invention)

The experiment employed graphite as electrode material. 74 g of di(2-methylbutyl/n-pentyl)maleate (289 mmol) and 24 g (58 mmol) of tetrabutylammonium p-toluenesulfonate were dissolved in 150 ml of pentanol and 27 ml of acetonitrile and—after sampling—subsequently filled into the intermediate storage vessel of the experimental apparatus. After starting the pump circulation at 280 l/h and adjusting the temperature control jacket to 50° C., a current of 600 mA (current density 6 mA/cm$^2$) was applied. The experimental duration was 13 hours. Over this period an electrical charge quantity of 0.29 F (corresponding to 1.01 F/mol of di(2-methylbutyl/n-pentyl)maleate) was supplied. The cell voltage was 5.8 V at commencement of the experiment and rose to 6.6 V by the termination of the experiment. After termination of the experiment, 224 g of product electrolyte solution were obtained and analysed by gas chromatography. Said solution contained 34.1 g of tetra(2-methylbutyl/n-pentyl) 1,2,3,4-butanetetracarboxylate (yield 46%, current yield 46%), 12.6 g of di(2-methylbutyl/n-pentyl) succinate (yield 17%), and 17.3 g of di(2-methylbutyl/n-pentyl) maleate (corresponding to a conversion of 77%).

Example 4 (in Accordance with the Invention)

The experiment employed boron-doped diamond as electrode material. 74 g of di(2-methylbutyl/n-pentyl)maleate (289 mmol) and 24 g (58 mmol) of tetrabutylammonium p-toluenesulfonate were dissolved in 150 ml of pentanol and—after sampling—subsequently filled into the intermediate storage vessel of the experimental apparatus. After starting the pump circulation at 280 l/h and adjusting the temperature control jacket to 50° C., a current of 600 mA (current density 6 mA/cm$^2$) was applied. The experimental duration was 13 hours. Over this period an electrical charge quantity of 0.29 F (corresponding to 1.01 F/mol of di(2-methylbutyl/n-pentyl)maleate) was supplied. The cell voltage was 5.7 V at commencement of the experiment and rose to 6.2 V by the termination of the experiment. After termination of the experiment, 210 g of product electrolyte solution were obtained and analysed by gas chromatography. Said solution contained 35.6 g of tetra(2-methylbutyl/n-pentyl) 1,2,3,4-butanetetracarboxylate (yield 48%, current yield 48%), 14.9 g of di(2-methylbutyl/n-pentyl) succinate (yield 20%), and 20.7 g of di(2-methylbutyl/n-pentyl) maleate (corresponding to a conversion of 72%).

The results of the exemplary embodiments 1 to 4 are compared with one another in the following table 1.

TABLE 1

Overview of the results of examples 1 to 4

| Example | 1 | 2 | 3 | 4** |
|---|---|---|---|---|
| Material Anode/Cathode | Glassy carbon/ glassy carbon | Graphite/ graphite | Graphite/ graphite | Boron-doped diamond/ boron-doped diamond |
| Anode surface area/cm$^2$ | 100 | 100 | 100 | 100 |
| Cathode surface area/cm$^2$ | 100 | 100 | 100 | 100 |
| Electrode distance/ mm | 1 | 2 | 2 | 1 |
| Current density/ mA/cm$^2$ | 6.0 | 6.0 | 6.0 | 6.0 |
| Temperature/° C. | 50 | 50 | 50 | 50 |
| Addition of acetonitrile/ml | — | — | 27 | — |
| Current yield */[%] | 51 | 37 | 46 | 48 |
| Average cell voltage over the entire duration of the experiment/V | 7.35 | 9.4 | 6.2 | 5.95 |
| Electrical energy consumption/kWh/t * | 1495 | 2646 | 1404 | 1291 |

* = Tetra(2-methylbutyl/n-pentyl) 1,2,3,4-butanetetracarboxylate
**= in accordance with the invention It can be seen from the overview in table 1 that the lowest average cell voltage was achieved when using boron-doped diamond electrodes. As a result, the electrical energy consumption for the electrohydrodimerization was the lowest compared to all other experiments.

The invention claimed is:

1. A process for producing tetraalkyl 1,2,3,4-butanetetracarboxylates containing alkyl groups having 1 to 6 carbon atoms by electrohydrodimerization in at least one reaction zone comprising an anode and a cathode with a reactant solution comprising dialkyl maleates containing alkyl groups having 1 to 6 carbon atoms, at least one monohydric alcohol having 1 to 6 carbon atoms, and a conducting salt, the process comprising:

electrohydrodimerizing the dialkyl maleates to afford tetraalkyl 1,2,3,4-butanetetracarboxylates at the cathode, wherein the anode and the cathode employed are boron-doped diamond electrodes.

2. The process according to claim 1, wherein the number of carbon atoms of the alkyl groups of the dialkyl maleates and the number of carbon atoms of the at least one monohydric alcohol are identical.

3. The process according to claim 1, comprising:

employing said conducting salt having tetraalkylammonium cations and/or alkali metal cations and having anions selected from the group consisting of aromatic-substituted sulfonates, alkylsulfonates, acetates, perchlorates, tetrafluoroborates, tetraphenylborates, bromides, iodides, phosphates, phosphonates, sulfates, alkylsulfates, and hexafluorophosphates.

4. The process according to claim 1, wherein the tetraalkyl 1,2,3,4-butanetetracarboxylates and the dialkyl maleates each have alkyl groups having 5 carbon atoms.

5. The process according to claim 1, wherein the at least one monohydric alcohol is methanol, butanol or a pentanol.

6. The process according to claim 1, further comprising:

employing, in the electrohydrodimerization, a cosolvent selected from the group consisting of acetonitrile, dimethyl sulfoxide, tetrahydrofuran, dioxane, propylene carbonate, N,N-dimethylformamide, organic carbonates, dichloromethane, chloroform and acetone.

7. The process according to claim 1, comprising:

performing the electrohydrodimerization at a temperature in a range from 20° C. to 80° C.

8. The process according to claim 1, comprising;

performing the electrohydrodimerization at a pressure of 0.5 to 3 bar.

9. The process according to claim 1, wherein said at least one reaction zone comprises an electrolysis cell, wherein a flow rate in the electrolysis cell is in a range between 50 and 700 l/h per 100 $cm^2$ of electrode surface area.

10. The process according to claim 1, comprising:

reacting the at least one monohydric alcohol having 1 to 6 carbon atoms to afford an aldehyde at the anode during the process.

11. The process according to claim 10, comprising:

forming valeraldehyde and 2-methylbutanal, when employing pentanol as the monohydric alcohol.

12. The process according to claim 1, comprising:

producing, by the electrohydrodimerization, the tetraalkyl 1,2,3,4-butanetetracarboxylates as tetramethyl 1,2,3,4-butanetetracarboxylate, and subsequently transesterifying the tetramethyl 1,2,3,4-butanetetracarboxylate with at least one monohydric alcohol having 2 to 6 carbon atoms to afford tetraalkyl 1,2,3,4-butanetetracarboxylates containing alkyl groups having 2 to 6 carbon atoms.

13. The process according to claim 12, comprising:

performing the transesterification at a temperature of 100° C. to 300° C.

14. The process according to claim 1, comprising:

producing, by the electrohydrodimerization, the tetraalkyl 1,2,3,4-butanetetracarboxylates as tetraethyl 1,2,3,4-butanetetracarboxylate, and subsequently transesterifying the tetraethyl 1,2,3,4-butanetetracarboxylate with at least one monohydric alcohol having 3 to 6 carbon atoms to afford tetraalkyl 1,2,3,4-butanetetracarboxylates containing alkyl groups having 3 to 6 carbon atoms.

* * * * *